US005451918A

United States Patent [19]

Sun

[11] Patent Number: 5,451,918

[45] Date of Patent: Sep. 19, 1995

[54] MICROWAVE MULTI-PORT TRANSFER SWITCH

[75] Inventor: Richard L. Sun, Redwood City, Calif.

[73] Assignee: Teledyne Industries, Inc., Los Angeles, Calif.

[21] Appl. No.: 237,799

[22] Filed: May 4, 1994

[51] Int. Cl.[6] ..... H01H 53/00

[52] U.S. Cl. ..... 335/4; 333/103

[58] Field of Search ..... 335/4, 5, 104, 105; 333/103, 105

[56] References Cited

U.S. PATENT DOCUMENTS

| | | | |
|---|---|---|---|
| 4,298,847 | 11/1981 | Hoffman | 333/105 |
| 4,633,118 | 12/1986 | Kosugi . | |
| 4,697,056 | 9/1987 | Hoffman | 333/105 |
| 5,065,125 | 11/1991 | Thomson et al. | 335/5 |
| 5,281,936 | 1/1994 | Ciezarek | 335/4 |

*Primary Examiner*—Lincoln Donovan
*Attorney, Agent, or Firm*—Skjerven, Morrill, MacPherson, Franklin & Friel

[57] ABSTRACT

A microwave multi-port switch has three operating positions and three RF paths. Six peripheral contact junctions are provided adjacent corners of a hexagonal cavity in an RF body and a common contact provided at the cavity center. Six reeds bridge over in and out of contact with adjacent ones of the peripheral contacts and six reeds extend between and in and out of contact with the peripheral contacts and the common contact. Reeds are actuated by movement of a coil-driven rocker through three actuating mechanisms, including a center post, at three levels above the body. The mechanisms include radially extending leaf springs, an actuator loosely keyed to the center post and a pivoted leaf spring movable by rocker tilting depressing the actuator, the leaf springs and fixed dielectric posts extending upwardly from the reeds.

13 Claims, 7 Drawing Sheets

MICROWAVE MULTI-PORT TRANSFER SWITCH

FIELD OF THE INVENTION

This invention relates to microwave switches. More particularly, it relates to a multi-port RF transfer switch in which at least three switch positions and at least three separate microwave paths per each position are provided.

BACKGROUND OF THE INVENTION

Heretofore, contacts between microwave coaxial connectors generally have been made by pushing on a pushrod, spring-return connected to an electrically-conductive reed or switch blade which positions the reed in a position bridging across conductive center pins of the connector. Typically the conductive parts are constructed of gold-plated beryllium copper which provides very good solderability, wear and RF qualities. Switching of the positions of a mechanical switch actuator can take place both in the power-off and power-on conditions. The pushrods can be actuated individually by actuating coils above each pushrod or a rotary drive may be used to sequence through an angular travel to depress each of the arrays of pushrods one-by-one. Single-pole-double throw (SPDT) coaxial switches have been employed to alter the path of an incoming signal to one or the other of two outputs or to select one input for an output. Particularly, current so-called T-switches for operating a 6-reed standard arrangement or array 10 of reeds shown in prior art FIG. 1 of U.S. Pat. No. 5,281,936 assigned to Applicant's assignee utilize a series of dielectric pushrods 11, each attached to a series of reeds 12*a* and 12*b*. Depression of one pushrod moves the reed 12*a* to electrically bridge across RF conductor contacts 14 and 15 and depression of another pushrod moves reed 12*b* to bridge across contacts 14 and 16, when the reeds are depressed by a force vector against a particular pushrod 11. FIG. 1 shows short reed 12*a* and long reed 12*b* in a switch open condition, while reed 12*c* and 12*d* are in a switch closed condition between contacts 14 and 17 and 15 and 16, respectively. Return springs 18 return the pushrods and reeds to their normal "unpushed" position upon release of the force vector. In the open stroke the reed is forced against the top of a housing cavity. This effectively presents a waveguide below cut off frequency.

The U.S. Pat. No. 5,281,936 discloses a random selection drive for selectively actuating one or more than one reed, e.g. two reeds, so that the reed(s) quickly, and with minimum travel and energy, bridge over a respective pair of microwave connector contacts of an array of such contacts, typically six in number. At least two actuators preferably in the form of cantilevered leaf springs, typically three in number, are mounted at different levels or parallel planes relative to the drive body. Means for displacing the leaf springs are provided, typically include a wobble plate having integral depending pusher arms of various lengths. The distal ends of the pusher arms terminate juxtaposed to a respective leaf spring in the same particular parallel neutral plane as the leaf spring. The pusher arms extend from the underside of the wobble plate facing the leaf springs. When the wobble plate is rocked by repelling or attraction forces provided by a series of spaced magnetic coils mounted on the drive body and spaced from a top side of the wobble plate, one or two of the leaf springs are displaced to push a particular reed(s) into bridging contact with a pair(s) of the array of microwave connector contacts.

FIGS. 1A, 1B and 1C of this application illustrate, respectively, the three operating portions of the prior art four port T-switch shown in U.S. Pat. No. 5,281,936 which provides two RF paths only.

The RF circuit in the prior art T-switch utilize TEM (transverse electromagnetic wave) transmission lines that have a rectangular cross section. A center-conductor is made up of rectangular transmission line sections. These sections of the transmission lines are moved, vertically, in or out of the contact with input and output connector-pins to provide the switching action. In the open state between a port and RF common the inner conductor is forced against the top of a cavity by a return spring. This effectively presents a waveguide below cutoff-frequency between these two ports. The resulting isolation for this path is a minimum of 70 Db from DC to 6 Ghz, and a minimum of 60 Db from 6 to 14 Ghz. The "closed" path between another port and RF common is maintained in contact with the connectors by a force supplied from a latching drive circuit. This path exhibits a very low insertion loss of less than 0.1 Db through 2.5 Ghz. The VSWR (voltage Standing Wave Ratio) of this path is also quite good, being typically 1.10:1 through 2.5 Ghz AND 1.30:1 through 14 Ghz.

The basic drive circuit in the prior art T-switch utilizes two coils, two magnetic iron cores, a rocker assembly, a magnetic iron support plate, and a permanent magnet. These parts are arranged in such a manner that two permanently magnetic paths are developed, namely one path for the "open" switch position, and the other for the "closed". Since the closed path is significantly stronger than the open path, the rocker will remain in a given position until acted upon by an opposing field. When a voltage pulse is applied to the coil in the closed path, the rocker is repelled and attracted by the core of the opposite coil. This latches the rocker in the opposite position. The change in rocker position activates (moves) the dielectric rods which control the vertical movement of the two inner conductors. This type of drive circuit has several advantages. The drive is extremely simple, having essentially only one moving part; the rocker. Low friction is provided by a single center-pivot point on the rocker. Efficiency is high because the contact gram-forces are maximized and the drive current is minimized. However, there has been a need to have a microwave transfer switch with more than two RF paths. This is desirable since this allows for the handling of additional signal transmission.

SUMMARY OF THE INVENTION

The present invention provides a multi-port transfer switch, hereinafter termed a Z-switch, which like the T-switch has three operating positions but which has three separate RF paths per each switch position unlike the two paths per switch position of the T-switches of the prior art. FIGS. 2A, 2B and 2C broadly show, respectively, the three operating positions of the Z-switch with three RF paths. The designations J1–J6 represent the contact junctions which are variously bridged by a series of conductors represented by the heavy lines. In a preferred embodiment there are twelve movable RF conductors, four of them are in contact with RF connector probes and remaining eight are open. The twelve conductors are grouped into three sets. Always one set is closed while two other sets are opened. The opening and closure of the RF conductors are activated by a rocker/actuator assembly. As shown in FIGS. 2A, 2B and 2C the "Z" Switch has three operating modes, namely:

Position 1—J1–J6, J2–J5 and J3–J4

Position 2—J5–J6, J1–J4 and J2–J3

Position 3—J1–J2, J3–J6 and J4–J5

The connections between junctions J2–J5, J1–J4 and J3–J6 are provided by means of two conductors and an internal junction located in the center of the RF body.

The drive mechanism of the Z-switch is based on the same concept as the drive circuitry described above but with significant modification to the T-switch drive mechanisms as required to realize "Z" Switch functions. This is because the Z-switch has three switching positions and nine RF paths. The modifications are in the coil magnet drive, rocker assembly and actuator assembly.

The invention utilizes a modified form of the ball pivot joint of the T-switch which eliminates a complex linkage mechanism needed by conventional design approaches for interaction among the three "Z" switching positions. The Z-switch provides a lightweight (approximately 220 grams) switch of high reliability and durability capable of a switching life greater than 100,000 operations per position. The Z-switch also provides for random access so that a single voltage pulse will latch the switch to a selected position regardless of previous state.

DETAILED DESCRIPTION

Figure 1A:
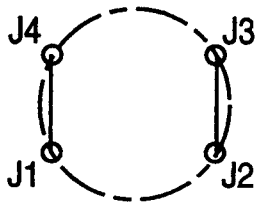
FIG. 1A (Prior Art)
FIG. 1A is a schematic plan view of a prior art 4-Port transfer T-switch at a Position 1.
Figure 1B:
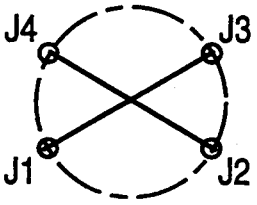
FIG. 1B (Prior Art)
FIG. 1B is a plan view of a Position 3.
Figure 1C:
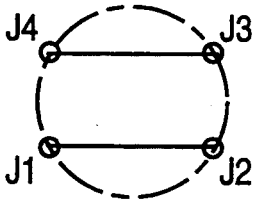
FIG. 1C (Prior Art)
FIG. 1C is a plan view thereof at a Position 2.
Figure 2A:
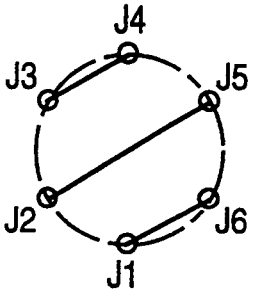
FIG. 2A is a schematic plan view of the 6-Port transfer Z-switch of the invention at a Position 1.
Figure 2B:
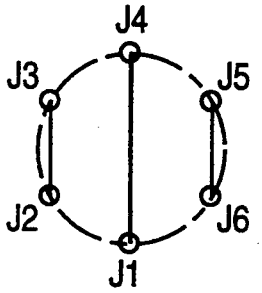
FIG. 2B a plan view thereof at a Position 2.
Figure 2C:
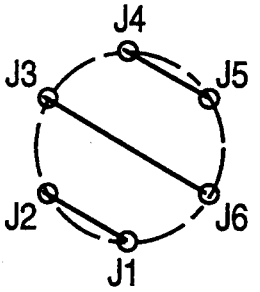
FIG. 2C is a plan view thereof at a Position 3.

FIG. 2A schematically illustrates the three separate RF paths J3–J4; J2–J5 and J1–J6 in a first relative position of the Z-switch. A total of six junctions are provided on the periphery of the Z switch. An internal common junction is located in the switch body cavity center as seen in FIG. 3 which center junction functions with pairs of conductors to provide the connections between J2–J5, J4–J1 and J3–J6.

Figure 3:
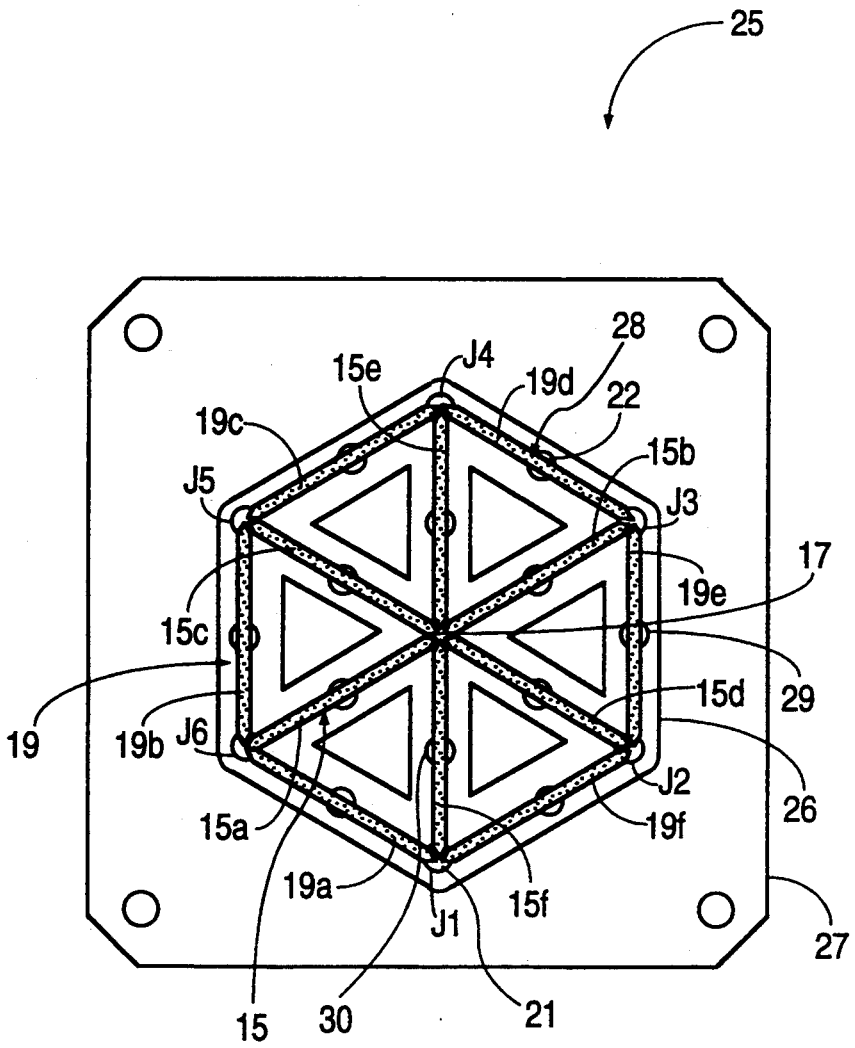
FIG. 3 is a schematic plan view of the RF cavity showing the junctions and moving RF reed conductors of a 6-Port transfer Z-switch of the invention.

FIG. 3 illustrates the RF cavity layout of switch 25 showing the conductors 15 and 19 and peripheral junctions J1–J6 of the invention. A central RF contact junction 17 is a contained within a polygonal, preferably hexagon-shaped, cavity 26 of a lower switch body 27. The peripheral junctions J1–J6, also known as probes, are spacedly positioned from each corner of the hexagon cavity. The tips of RF conductors 19*a*–19*f*, which conductors are in the form of six thin movable reeds are positioned to the moved into and out of contact with the probes J1–J2, J2–J3, J3–J4, J4–J5 and J5–J6, respectively. The tips of radial RF conductors 5*a*–15*f*, which conductors are also in the form of thin movable reeds, are positioned to be moved into or out of contact with one of probes J1–J6 and the common central contact junction 17. While the invention has been described in terms of a polygonal cavity, the peripheral junctions can be spaced around a circular cavity and can be curved to conform to the curve of the cavity or be chordal in nature. Thus, a large number of conductive reeds 19 can be accommodated, along with a large number of radial reeds extending to the central junction.

The array 28 of moving reeds are twelve in number. In operational modes, four of the reeds are in contact with RF connector probes J1–J6 and 17 and the remaining eight reeds are open. The twelve conductive reeds 15 and 19 are grouped into three sets, with one set closed and the other sets open. The opening and closing of the conductive reeds are activated by a rocker/actuator assembly described hereafter with respect to FIGS. 4–7.

Figure 4:
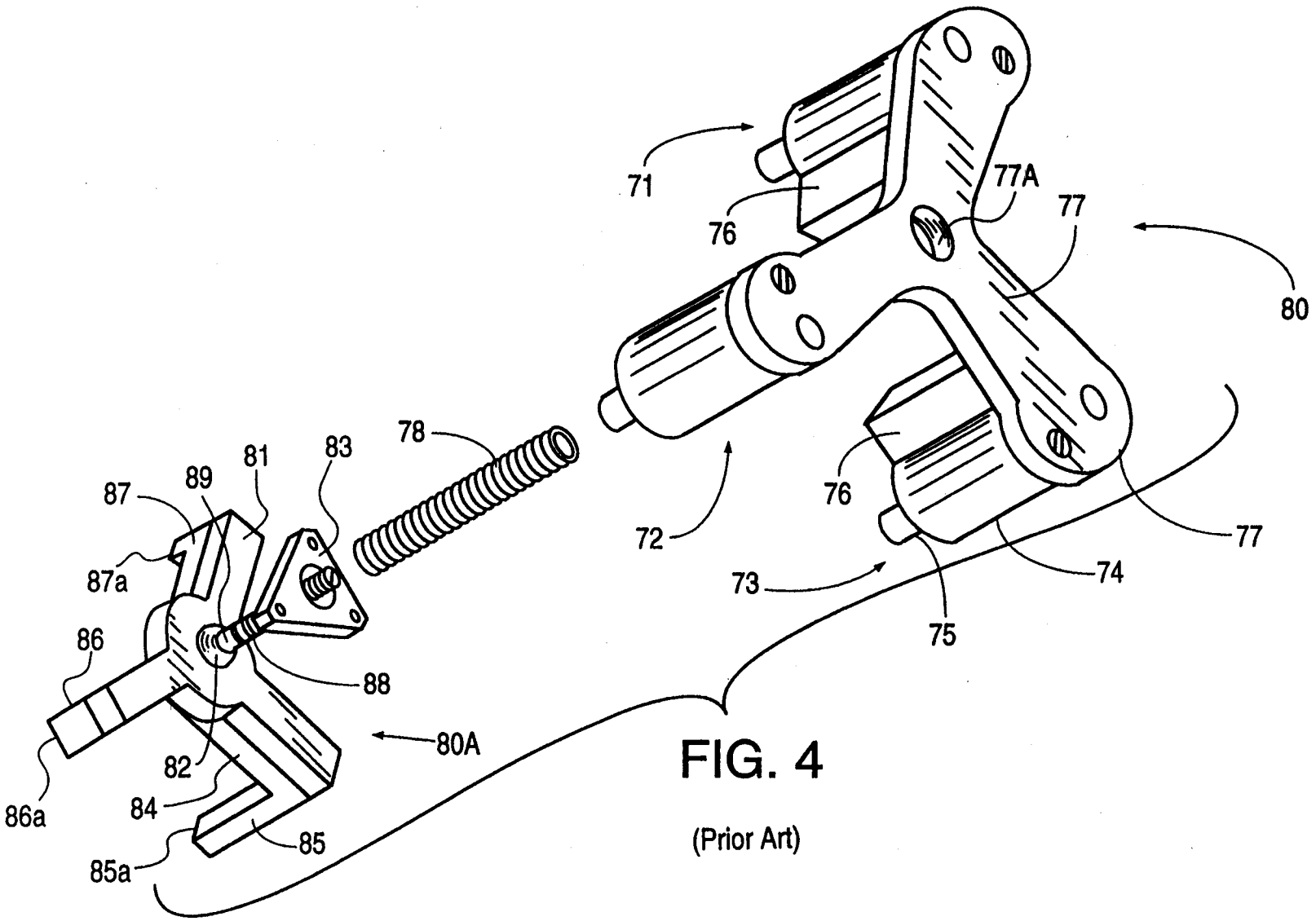
FIG. 4 (Prior Art)
FIG. 4 is an exploded perspective view of a prior art random drive assembly.

The "Z" switch drive 80 shown in FIG. 4 has three drive sections 71, 72 and 73. This drive is similar to the drive in FIG. 5 of U.S. Pat. No. 5,281,936. Each section comprises one coil 74, one core 75 and one permanent magnet 76. A magnet plate 77 physically holds the three sections together at 120° apart from each other. A threaded stub 78 is threadedly connected to an aperture 77*a* in magnetic plate 77 links the drive assembly to the rocker assembly 80. These parts are arranged in such a manner that three magnetic paths are developed, one path for "open" drive position, two others for the "closed". Since the closed paths are significantly stronger than the open path, the rocker will remain in a given position until subjected to a field generated by the coils. When the voltage pulse is applied to the coils the rocker is repelled by one core and attracted by two other cores so as to latch the assembly 80 in the required position.

Further as illustrated in FIG. 4, a switch rocker assembly 80A is provided in the form of a three-arm, "Y" shaped mechanism. In the center of the rocker a ball joint is formed by a link 89 with a ball 82 on one end which is captivated between a triangle plate 83 and a spherical cavity in a "Y" shaped rocker plate 81. An adjusting screw 88 with a slotted head provides axial adjustment of the wobble plate/rocker 81 and spacing-/angularity of the rocker. The plate 83 is screw mounted to the top of rocker plate 81. The ball joint serves as an effective angular-pivot for the "Y" shaped rocker. Attached to the rocker plate is a pusher plate 84 with three orthogonal pushers 85, 86 and 87. Each pusher has unique length that activates a corresponding actuator positioned at three predetermined vertically displaced levels, by pushing action by the pusher ends 85*a*, 86*a*, and 87*a*.

Figure 5:
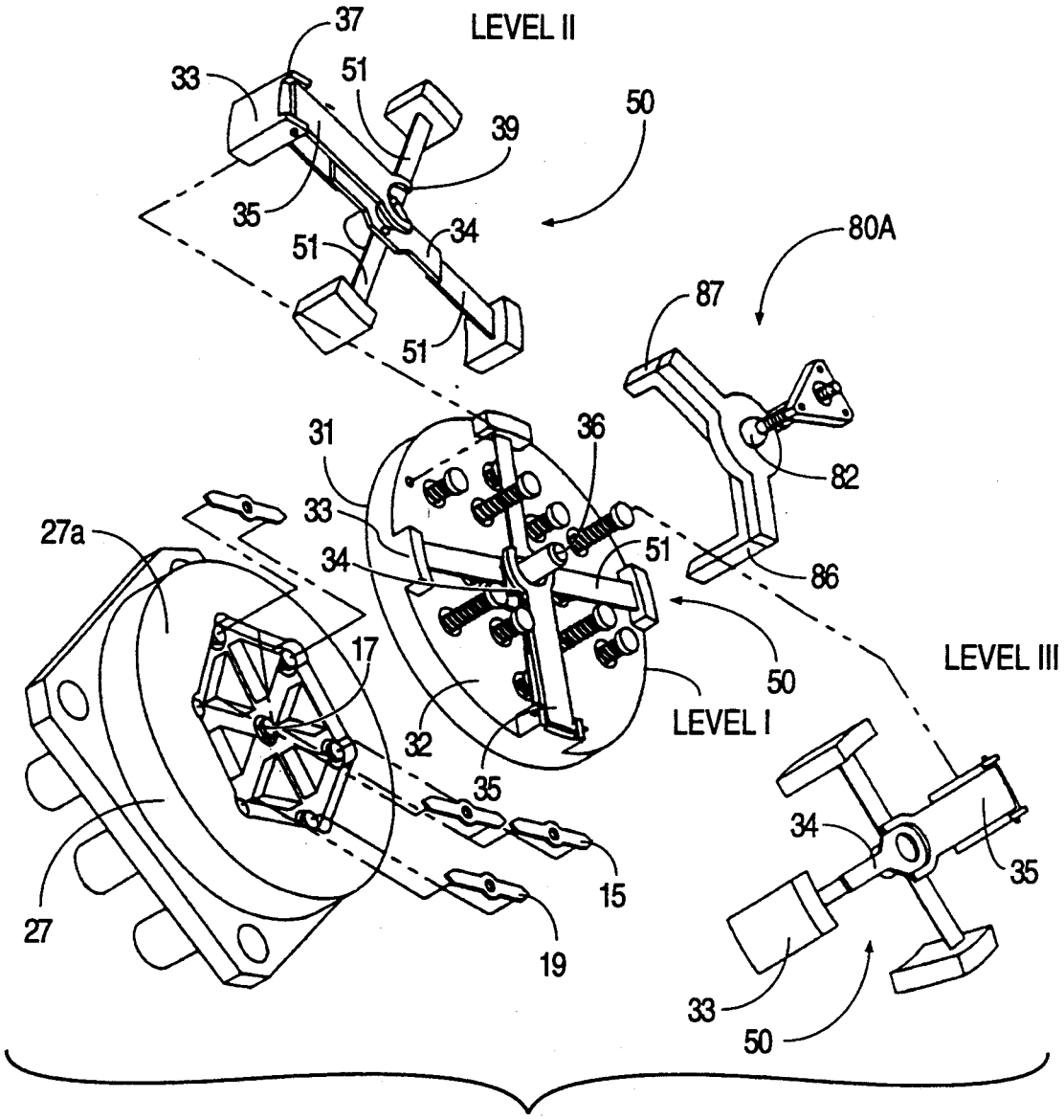
FIG. 5 is an exploded perspective view of the Z-switch of the invention showing only the rocker arms and particularly illustrating the actuating mechanisms at Levels I, II and III.

As shown in FIG. 5, there are three actuating mechanisms 50 located at three different vertical levels, namely, Levels I, II, and III. The actuating mechanisms 50 are mounted on the top 27*a* of an RF section lower portion or body 27 and are evenly spaced 120° apart. Each actuating mechanism 50 activates simultaneously four movable RF conductors to provide required interconnections for each switch position. Each actuating mechanism 50 comprises four leaf springs 51, one set fixed at one end to raised pillars 33 extending upwardly from the upper RF portion or body 31 to a level just above a top dielectric surface 32, the other Levels sets having depending pillers 33 extending downwardly to surface 32; one actuator 34 guided on the center post 36 of the upper RF body to provide movement in one axis perpendicular to the leaf springs' plane; and one leaf 35 pivoted in the upper RF body and located to be in line with a corresponding rocker arm e.g. arm 87. The upper body 31 is nested on the lower body 27. For purposes of clarity the switch drive and link of FIG. 4 has been omitted from FIG. 5. Each actuator mechanism 50 is axially aligned with a respective one of the three rocker arms 85, 86 and 87 and the coil-magnet drive sections 71, 72 and 73 (FIG. 4). The pillars 33 on the respective mechanisms 50 are of different lengths allowing each actuating mechanisms to be at a different height. The pillars of the Level 1 mechanism are short, the pillars of the Level III mechanism are long and the pillars for the Level II mechanisms are of an intermediate length.

The RF upper and lower bodies and pillars are preferably constructed of aluminum alloy plate 6061-T6 per QQ-A-250/II finished With bright electroless nickel plate 0.0003–0.004 inch thick per MIL-C-26074, CL. 4. The reeds are preferably constructed of beryllium copper alloy 172 per QQ-C-533 condition ¼ H or ½ H, heat treated 38 HRC min. with a gold finish.

Assuming that switch is in the steady-state, (coils are not energized), the pusher of that rocker arm in "open" position is pressing down the corresponding leaf spring 35. The leaf spring 35 transfers the pressure through the actuator 34 to the four leaf springs 51 deflecting them toward the upper RF body. Deflection of the leaf springs 51 applies pressure to the corresponding RF conductors providing all interconnections for the chosen position.

Figure 6:
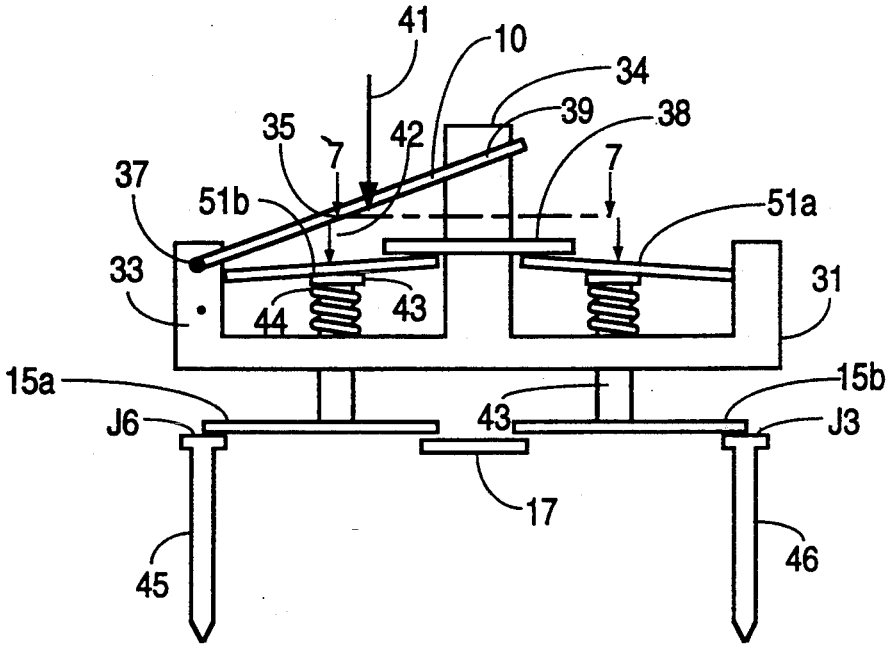
FIG. 6 is a schematic side view of one level of the switch actuating mechanism.
Figure 7:
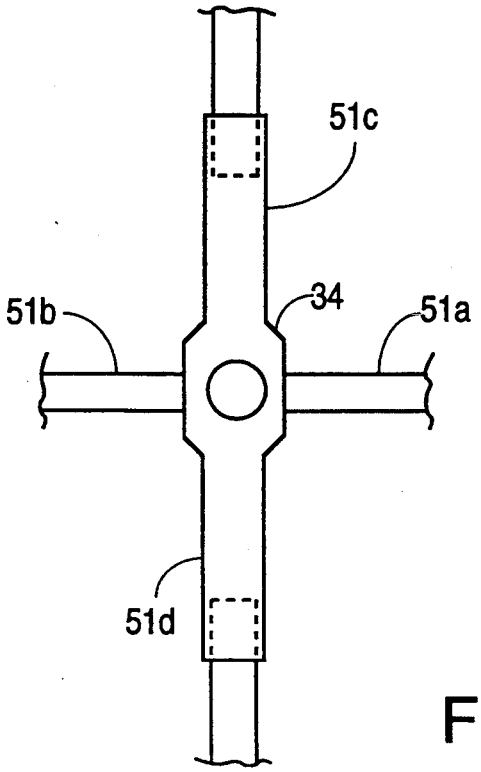
FIG. 7 is a partial top view taken on the line 7—7 of FIG. 6, particularly showing the center guide post and keyed elongated washer.

The above action is seen more clearly in FIGS. 6 and 7. The leaf spring 35 includes a fork end 39 best seen at Level II in FIG. 5, and is positioned with the fork end against a center guide post 36. The other end of the spring 35 is pivoted about pivot 37 mounted on pillar 33. The actuator 34 is in the form of an elongated washer loosely keyed to the center post 36 and extending below the spring fork end 39 and above leaf springs 51*a*, 51*b*, 52*c*, and 51*d*.

As a selected pusher is wobbled to a selected position, the pusher arm comes down (arrow 41) against leaf spring 35 which spring 35 is pivoted down (arrow 42) against washer 34 which in turn forces the washer against all four of the leaf springs 51*a* and 51*b* and 51*c* and 51*d* (FIG. 7). The leaf springs 51 then are forced down on the tops of dielectric posts 43 which are surrounded by return compression springs 44. The bottom of the posts 43 are fixedly connected to individual reeds, e.g. reeds 15*a* and 15*b*, which when depressed, bridge over in electrical connection between the central junction 17 and for example the peripheral junctions J6 and J3 (FIG. 3) and the RF connection contacts 45 and 46 extending therebelow. Movement of the rocker to a different wobble position activates a different actuator 50 at another vertical level dependent on the length of the pusher arms 85, 86 or 87 selected to be in the "down" position. When the pusher force releases (due to re-rocking of the wobble plate or rocker 80) each spring 35 springs back up and the leaf springs 51*a*–51*d*, predetermined biased upwardly by springs 43, and the reeds 15*a* and 15*b*, for example, are released by the spring action of springs 43, allowing the reeds to raise off junctions J6 and J3 placing that part of the switch in "open" condition.

A three position, three RF path switch is thus provided having one long reed path made up of two reeds extending radially aligned and passing through common central junction 17, and two short paths extending between two pairs of immediately adjacent peripheral junctions as seen in FIGS. 2A, 2B, and 2C and FIG. 3.

Figure 8:
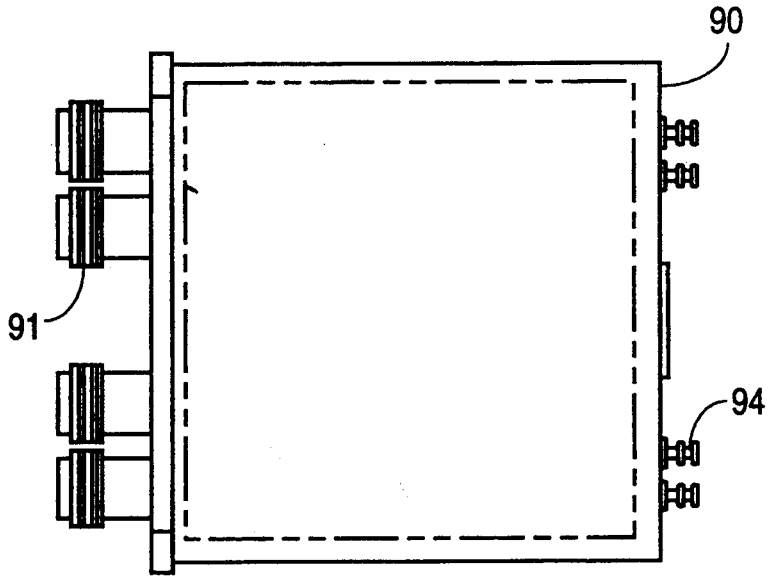
FIG. 8 is an exterior side view of the Z-switch.
Figure 9:
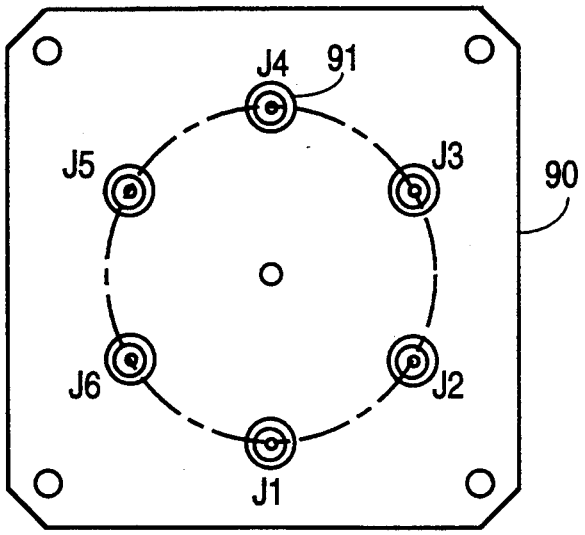
FIG. 9 is an end view thereof showing the RF connectors.
Figure 10:
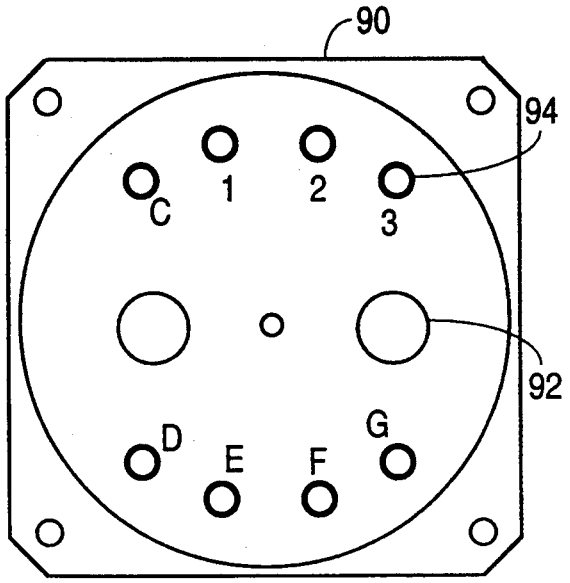
FIG. 10 is an opposite end view thereof showing solder terminals for the interior actuating coils.

FIG. 8 shows the exterior of the switch housing 90 having screw connector ports 91 on one end for receiving co-axial RF cables connecting to other RF components. The bottom ends of junctions J-1 through J-6 are seen exposed in FIG. 9. FIG. 10 illustrates solder terminals C, 1, 2, 3, D, E, F, and G and housing venting screens 92, for equalizing pressure within the switch housing and ambient pressure, between connector terminals 94.

Figure 11:
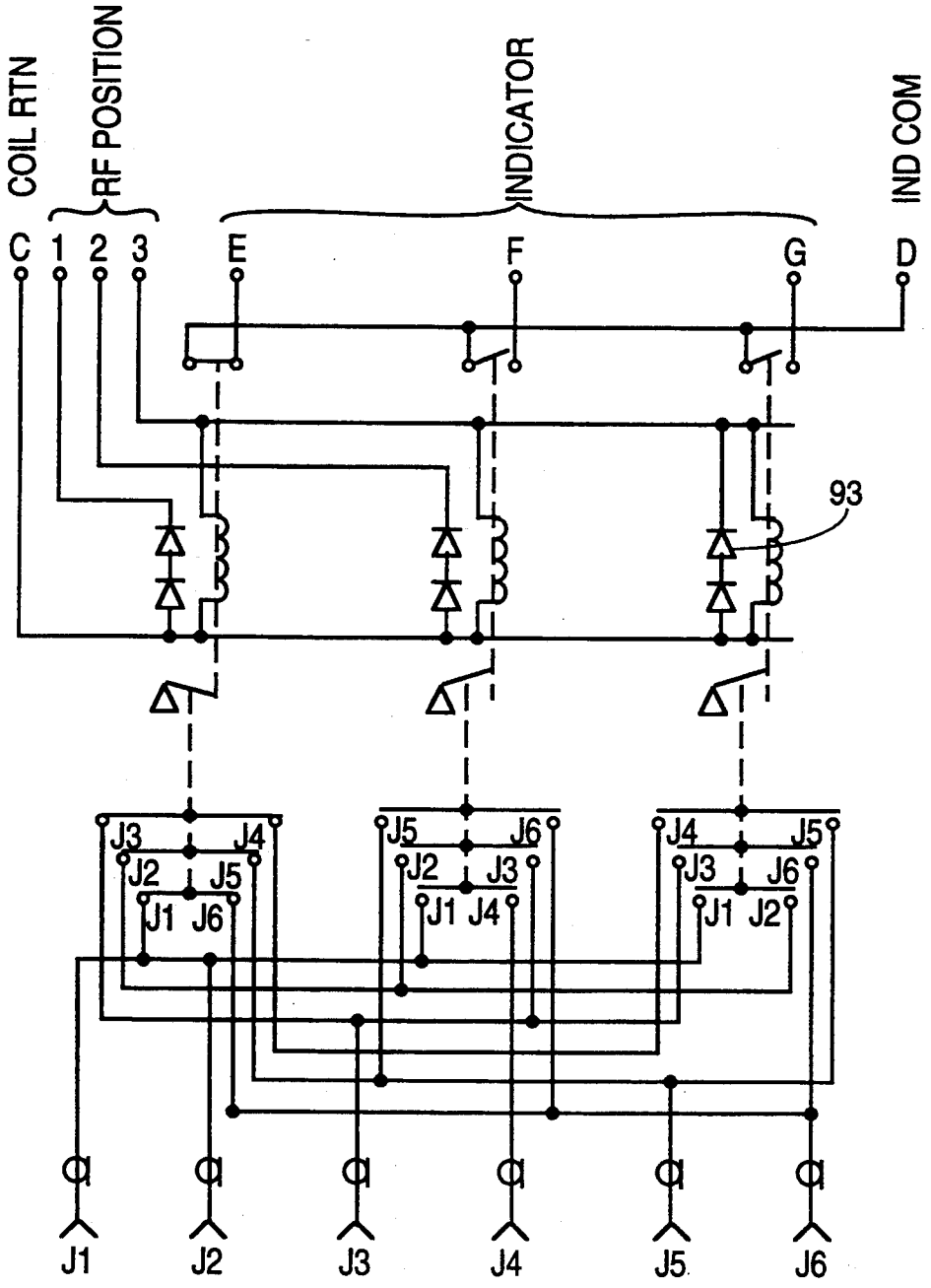
FIG. 11 is a circuit schematic of the Z-switch shown in Position 1.

FIG. 11 is a schematic diagram of the switch circuit in Position 1 (FIG. 2A). To switch to a required position, a positive voltage pulse is applied to an appropriate coil through the designated terminals. Voltage transient suppression diodes 93 are utilized. Each pulse energizes one of the three coils to generate a repelling switching force between the selected coil and the wobble plate. The repelling force between the one core and the selected rocker arm repels and pushes one of the rocker arms, while the other two rocker arms will snap-away toward their associated unenergized cores. The repelled arm simultaneously forces down the springs of the selected actuating mechanism 50 at a chosen level.

While the invention has been described in terms of a polygonal hexagon cavity, similar actuating mechanisms, for example, with an octagonal or other shaped cavity for 16 or more reeds, may be utilized and the same rocker-type pusher and drive circuit provided, which will actuate a greater number of RF reed-type conductors. This will result in a fourth RF path or additional paths depending on the number of reeds. Actuating mechanisms can be added at a fourth or more levels and a four-way or more rocker-type pusher and drive circuit provided.

For a high power coaxial switch operating under vacuum condition, special considerations should be employed in the design of the RF section. They are multipaction and power dissipation. Multipacting breakdown will occur when the electron transit time between the electrodes in the switch (i.e., the inner and outer conductor) is approximately one half cycle of the applied FR field. This condition has been documented in an RF voltage breakdown analysis, NASA JPL Technical report 32-1500, by Richard Woo, October 1970. The report normalizes this condition in terms of the Fd product of the device where F is the frequency measured in Mhz and d is the inner-to-outer conductor distance in air measured in centimeters. The mean free path of the electrons must be on the same magnitude of the separation distance between electrodes in order for multipaction to occur. The requirement for one embodiment of the "Z" switch is: 70 watts min., 100 watts, max.

at 1650 and 2500 Mhz. The critical region for the Fd product to sustain RF breakdown at 100 watts, cw, is approximately between 70 and 180 Mhz-cm. Analysis of the "Z" switch reveals that the required min. distance between conductors is 0.115 cm which at 1650 Mhz provides an Fd product of 190 MHz-cm which is beyond the critical Fd region necessary for multipaction. The power of dissipation due to insertion loss of the "Z" switch at worst case (100 watts cw) will increase the internal unit temperature by approximately 30° C. The maximum operating temperature of the switch is +70° C.; therefore, the internal unit temperature will be +100° C. The "Z" switch should be designed to operate at +125° C. and to withstand a maximum temperature of −150° C. without any physical degradation. Hence, with high RF power applied to the switch, there will be no damage caused to the switch.

The above description of the preferred embodiment of this invention is intended to be illustrative and not limiting. Other embodiments of this invention will be obvious to those skilled in the art in view of the above disclosure.

I claim:

1. A microwave multiport transfer switch comprising a cavity;

a central junction contact in said cavity;

a series of at least six conductive peripheral junctions positioned adjacent the periphery of the cavity;

a first series of at least six conductive peripheral reeds each generally aligned with the periphery of said cavity and adapted to bridge across adjacent pairs of said peripheral junctions;

a second series of at least six conductive radial reeds each extending radially from a position above said central junction contact to a position above a respective one of said peripheral junctions, wherein said at least twelve reeds are grouped into at least three sets and said switch is movable in at least three modes to provide at least three separate microwave paths such that at in any one mode of operation one set is open and at least two sets are closed;

wherein pairs of said conductive radial reeds are linearly aligned with each other, with said central junction contact and with opposite ones of said peripheral junctions; and a plurality of switch actuating mechanisms for contacting each pair of said radial reeds and for simultaneously contacting a pair of said peripheral reeds, such that said pair of said radial reeds and said pair of peripheral reeds are simultaneous depressed to radially electrically connect two opposed peripheral junctions and to peripherally electrically connect each of two opposed pairs of adjacent peripheral junctions.

2. The switch of claim 1 wherein a first set of the at least three sets includes a first reed extending between a first peripheral junction and a first immediately next peripheral junction;

a second set of the at least three sets includes a second reed extending between said first immediately next peripheral junction and a second immediately next peripheral junction; and a third set of the at least three sets includes a third reed extending between said second immediately next peripheral junction and a third immediately next peripheral junction.

3. The switch of claim 2 wherein said first reed, said second reed and said third reed are parallel to a pair of linearly aligned reeds one radially extending from above said central junction contact to an immediately prior peripheral junction from said first peripheral junction and the other extending from above said central junction contact to said second immediately next peripheral junction.

4. The switch of claim 1 including a coil-magnet drive having three sections, each section comprising a coil, a core and magnet, and a rocker variously activated by one of said sections to a desired mode of switch operation.

5. The switch of claim 4 in which said rocker comprises a three-arm actuator rockable about a ball joint, a pusher plate with three pushers of different lengths and where said switch actuating mechanisms comprise three actuating mechanisms mounted 120° apart at different levels in a body extending above said cavity, each mechanism simultaneously activating multiple ones of said reeds to provide a desired interconnection of said multiple ones of said reeds for each of the modes of switch operation.

6. The switch of claim 5 wherein each of said actuating mechanisms includes a central guide post connected to said body.

7. The switch of claim 6 wherein said activating mechanisms further include a series of spaced leaf springs positionable over multiple ones of said first and second series of reeds and adapted to contact dielectric posts attached to said multiple ones of said reeds, said leaf springs radially and spacedly extending from said guide post, a washer loosely keyed to said guide post and in contact with said series of spaced leaf springs, and a pivoted actuating spring movable by one of said pushers to move said washer against and to depress said leaf springs, which in turn depresses selected ones of said dielectric posts and said multiple ones of said reeds.

8. A microwave multiport transfer switch comprising a first switch portion;

a central junction contact in said first switch portion;

a series of peripheral electrical contacts extending around said central junction contact;

movable conductive reeds in said first switch portion and movable to bridge across peripheral electrical contacts in the first switch portion and simultaneously to bridge across and between said central junction contact and selected ones of said peripheral electrical contacts;

dielectric posts extending from each of said reeds;

a rocker for variously activating a selected series of said conductive reeds and posts;

actuating mechanisms positioned on a second switch portion operable by said rocker to variously move selected ones of said reeds and posts; and wherein said actuating mechanisms each comprise a series of leaf springs positionable over selected ones of said dielectric posts; a washer loosely keyed to a center post extending from said second switch portion and in contact with each of said series of leaf springs; and a pivoted actuating spring pivotably actuatable by said rocker to collectively depress said series of leaf springs and said selected ones of said dielectric posts.

9. The switch of claim 8 in which said first switch portion includes a hexagon cavity and wherein said conductive reeds are twelve in number, six reeds extending parallel to each hexagonal side of said cavity and between adjacent pairs of said peripheral electrical contacts and six of which extend radially from ones of said electrical contacts to said central junction contact.

10. The switch of claim 8 wherein each of said mechanisms is positioned at a different vertical level with respect to said first switch portion.

11. The switch of claim 10 wherein said actuating mechanisms includes radially spaced first pillers fixedly supporting the outer peripheral ends of a first of the series of leaf springs in a first level;

wherein a second and third series of leaf springs are at different second and third levels and are attached at their outer peripheral ends to spaced second pillers and spaced third pillers, respectively, said second pillers being of a different length than said third pillers, each piller being laterally spaced from each other and laterally spaced from said first pillers; and wherein said rocker actuates a series of leaf springs at only one selected level.

12. The switch of claim 8 wherein the first switch portion includes a cavity of a polygonal shape.

13. The switch of claim 12 wherein the cavity is of a hexagon shape.

* * * * *

UNITED STATES PATENT AND TRADEMARK OFFICE

CERTIFICATE OF CORRECTION

PATENT NO. : 5,451,918
DATED : September 19, 1995
INVENTOR(S) : Richard L. Sun

It is certified that error appears in the above-identified patent and that said Letters Patent is hereby corrected as shown below:

Column 2, line 8, delete "(transverse electromagnetic wave)" and insert --(transverse electromagnetic wave)--.

Column 2, lines 24-25, delete "(voltage Standing Wave Ratio)" and insert --(Voltage Standing Wave Ratio)--.

Signed and Sealed this

Seventh Day of May, 1996

Bruce Lehman

*Attest:*

BRUCE LEHMAN

*Attesting Officer*

*Commissioner of Patents and Trademarks*